United States Patent [19]

Adams

[11] Patent Number: 4,895,089

[45] Date of Patent: Jan. 23, 1990

[54] STEPPER DRIVEN WORK FEED PATTERNING FOR SEWING MACHINES

[75] Inventor: Kenneth D. Adams, Madison, N.J.

[73] Assignee: SSMC Inc., Fairfield, N.J.

[21] Appl. No.: 304,523

[22] Filed: Feb. 1, 1989

[51] Int. Cl.[4] ..... D05B 27/00

[52] U.S. Cl. ..... 112/316; 112/317

[58] Field of Search ..... 112/316, 314, 317, 462

[56] References Cited

U.S. PATENT DOCUMENTS 4,167,912 9/1979 Sedlatschek et al. ..... 112/458

4,183,314 1/1980 Sato ..... 112/316

4,499,839 2/1985 Blackwood et al. ..... 112/317

*Primary Examiner*—Andrew M. Falik

*Attorney, Agent, or Firm*—Theodore C. Jay

[57] ABSTRACT

A sewing machine employs stepper motor actuated control for magnitude and direction of work feed including operator influenced feed balancing cam apparatus for shifting the stepper motor actuated control axially relative to or with a stepper motor shaft in order to attain parity between forward and reverse directions of work feed.

4 Claims, 3 Drawing Sheets

STEPPER DRIVEN WORK FEED PATTERNING FOR SEWING MACHINES

BACKGROUND OF THE INVENTION

This invention relates to sewing machines in which stitch patterning capability is provided by means for controlling the magnitude and direction of work feed. More particularly, this invention relates to sewing machine work feed control by stepper motor actuation as dictated by electronic stitch pattern data with novel improved operator influenced control of the balance between forward and reverse direction of work feeding motion.

DESCRIPTION OF THE PRIOR ART

The use of stepper motors as actuators for translating electronically stored work feed instructions into sewing machine work feed magnitude and direction is well known. In the operation of sewing machine work feeding mechanisms there are numerous factors which can vary the effectiveness of the work feed in one direction as compared with the opposite direction. Such factors may include the nature, thickness, and nap of the fabrics being stitched; the surface characteristics of the fabric engaging work feed element of the sewing machine; and the nature and surface characteristics of the presser device opposing the work feed element.

The term "balance control" refers to means, usually manually operator influenced, for adjusting the sewing machine work feeding mechanism or controls so as to attain uniformity in the forward and reverse direction of work feed magnitude.

The U.S. Pat. No. 4,167,912 Sept. 18, 1979 of R.L. Sedlatschek et.al. discloses a stepper actuated work feed control for sewing machines in which operator influenced adjustment of the balance between opposite directions of work feed is provided by a translatory shiftable mounting for the entire stepper motor in a direction parallel to the stepper motor shaft and manually operable means for shifting the entire stepper and the mounting means. The high cost incident to the complicated stepper motor mounting required by the construction of U.S. Pat. No. 4,167,912, the inordinate space required within the limited confines of a typical sewing machine frame, as well as the liklihood of binding forces arising in the stepper drive due to variation in the symetry of the translating shiftable stepper motor mount all militate against satisfactory utilization of that disclosure.

SUMMARY OF THE INVENTION

It is the object of the invention to provide a stepper actuated drive mechanism for controlling magnitude and direction of sewing machine work feeding including a simple and cost effective operator influenced work feed balancing arrangement applicable without generating any binding forces to the stepper activated drive mechanism.

The object of the invention is attained in a stepper activated drive mechanism including a rotatable drive element capable of shifting a follower parallel to the axis of rotation of the drive element by the provision of operator influenced cam means actuating in opposition to the spring biasing means for bodily shifting the drive element along its axis of rotation. A particularly effective embodiment of this invention where the drive element is secured on or arranged coaxially of the stepper motor shaft involves cam influence in opposition to spring bias of both the drive element and stepper motor shaft together.

BRIEF DESCRIPTION OF THE DRAWINGS

With the above and additional objects and advantages in view, as will hereinafter appear, this invention will now be described with reference to the preferredembodiments illustrated in the accompanying drawings in which.

DETAILED DESCRIPTION

Figure 1:
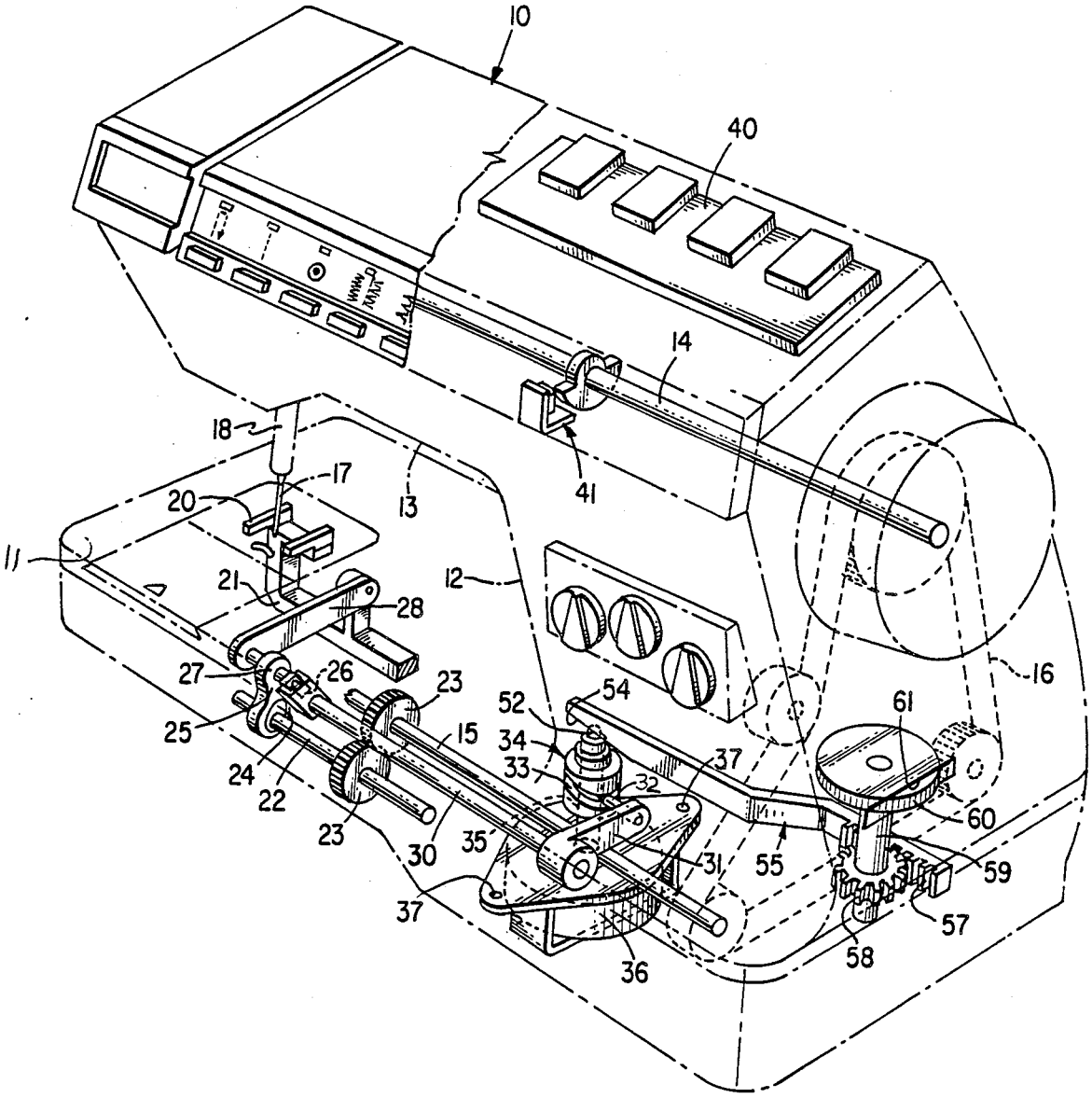
FIG. 1 is a perspective view of a sewing machine including portions of a typical work feeding mechanism and illustrating a stepper actuated mechanism for influencing the direction and magnitude of work feeding motion with operator influenced balance control in accordance with this invention.

FIG. 1 illustrates a sewing machine indicated generally at 10 having a frame including a bed 11, a standard 12 rising from the bed, and a bracket arm 13 overhanging the bed. The driving mechanism of the sewing machine includes an armshaft 14 and a bed shaft 15 interconnected by a timing belt 16 in the standard. A needle 17 carried for endwise reciprocation by a needle bar 18 is mounted for movement in bracket arm 13. Any conventional connections not shown may be used between the armshaft 14 and the needlebar 18 for imparting needle reciprocation.

The work feeding mechanism includes a feed dog 20 carried by a feed bar 21. The feed bar 21 may be supported in the bed 11 by any conventional means (not shown) for accomodating work transporting movements of the feed dog transversely across the bed 11 as well as vertical movements to shift the feed dog alternately into and out of work engagement on work feed and idle return strokes of feed dog work transporting movements.

In FIG. 1 a mechanism is illustrated for imparting work transporting movement to the feed dog 20 including a feed drive shaft 22 driven by gears 23 from the bed shaft 15, an eccentric cam 24 on the feed drive shaft 22, a pitman 25 embracing the eccentric 24 and connected to reciprocate a slide block 26 in a slotted feed regulating guideway 27. A link 28 pivotally connects the pitman 25 with the feed bar 21 so that depending upon the inclination of the guideway, regulation of the magnitude and direction of the feed stroke of the feed dog may be controlled.

The guideway 27 is fast on a rock shaft 30 journaled in the bed and a rock arm 31 secured on the rock shaft 30 supports a follower pin 32 which tracks a spiral cam groove 33 formed radially in a cam member 34 made fast on the shaft 35 of a stepper motor 36 secured as by fastenings 37 in the sewing machine bed 11.

The stepper motor 36 is actuated in response to stitch pattern signals stored in an electronic stitch pattern memory indicated generally at 40 in FIG. 1. The stitch pattern signals may be extracted in sequence from the memory at an appropriate time preceeding each stitch in the pattern in response to timing pulses from a pulse generator 41, associated with the sewing machine arm shaft 14.

In sewing machine work feed mechanisms of the type described above, the fabrics being stitched do not always move an exact amount matching that of the work transporting movement of the feed dog. It is frequently the case that precisely equal work transporting motions of the feed dog in opposite directions of feed will result in noticeably different work feed or stitch lengths, and particularly where patterns of stitches are being being formed, extremely small stitch length differences of this nature can be especially noticeable.

Figure 2:
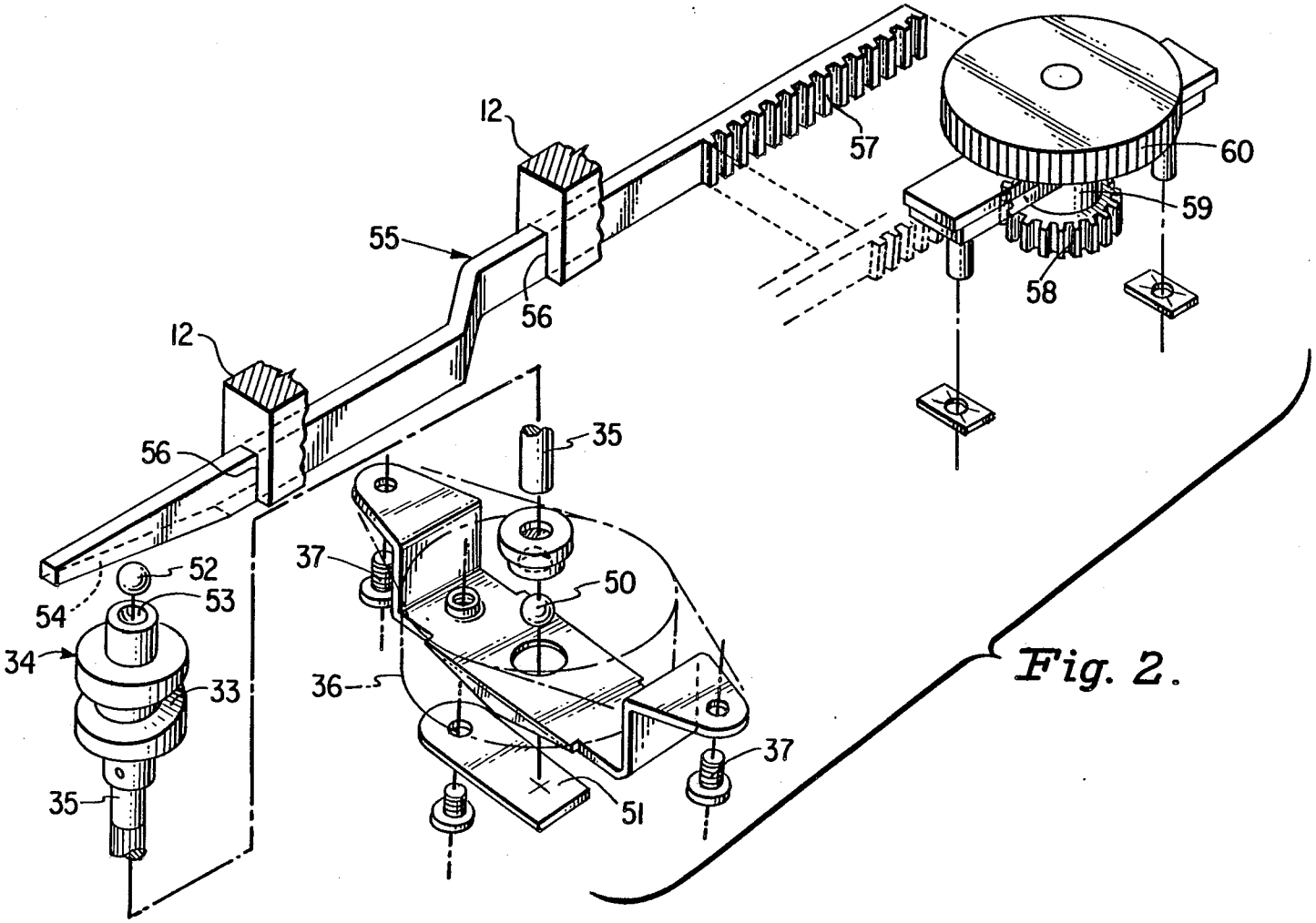
FIG. 2 is a disassembled perspective view of the stepper actuated mechanism and operator influenced balance control shown in FIG. 1.

A preferred embodiment of an operator influenced work feed balancing mechanism in accordance with this invention is illustrated in FIGS. 1 and 2. In this embodiment, the cam member 34 is secured directly on the stepper motor shaft 35 and the stepper motor shaft is journaled for limited axial movement.

A bearing ball 50 constrained coaxially of the stepper motor shaft against the opposite extermity of the shaft 35 from the cam member 34 is engaged and biased toward the cam member 34 by a leaf spring 51 which may be retained by the stepper motor fastenings 37.

At the opposite extremity of the stepper motor shaft 35 adjacent the cam member 34 another ball bearing 52 is constrained in a concavity 53 coaxially in the stepper shaft extremity. The ball bearing 52 is opposed by the tapered cam 54 formed on one extremity of a bar 55 endwise slidsably constrained in a guide groove 56 formed in the sewing machine bed.

At the opposite extremity of the cam 54 the bar 55 is formed with a rack 57 guided in mesh with a gear 58 which is fast on a stub shaft 59 to which a dial 60 is secured. As shown in FIG. 1, the dial 60 may be arranged so as to protrude through an opening 61 in the sewing machine standard 12 for ready access by the sewing machine operator.

By turning the dial 60, the sewing machine operator may influence movement of the inclined cam 54 toeffect axial shift of the cam member 34 in opposition to the bias of spring 51 to balance the forward and reverse directions of work feed movements.

Figure 3:
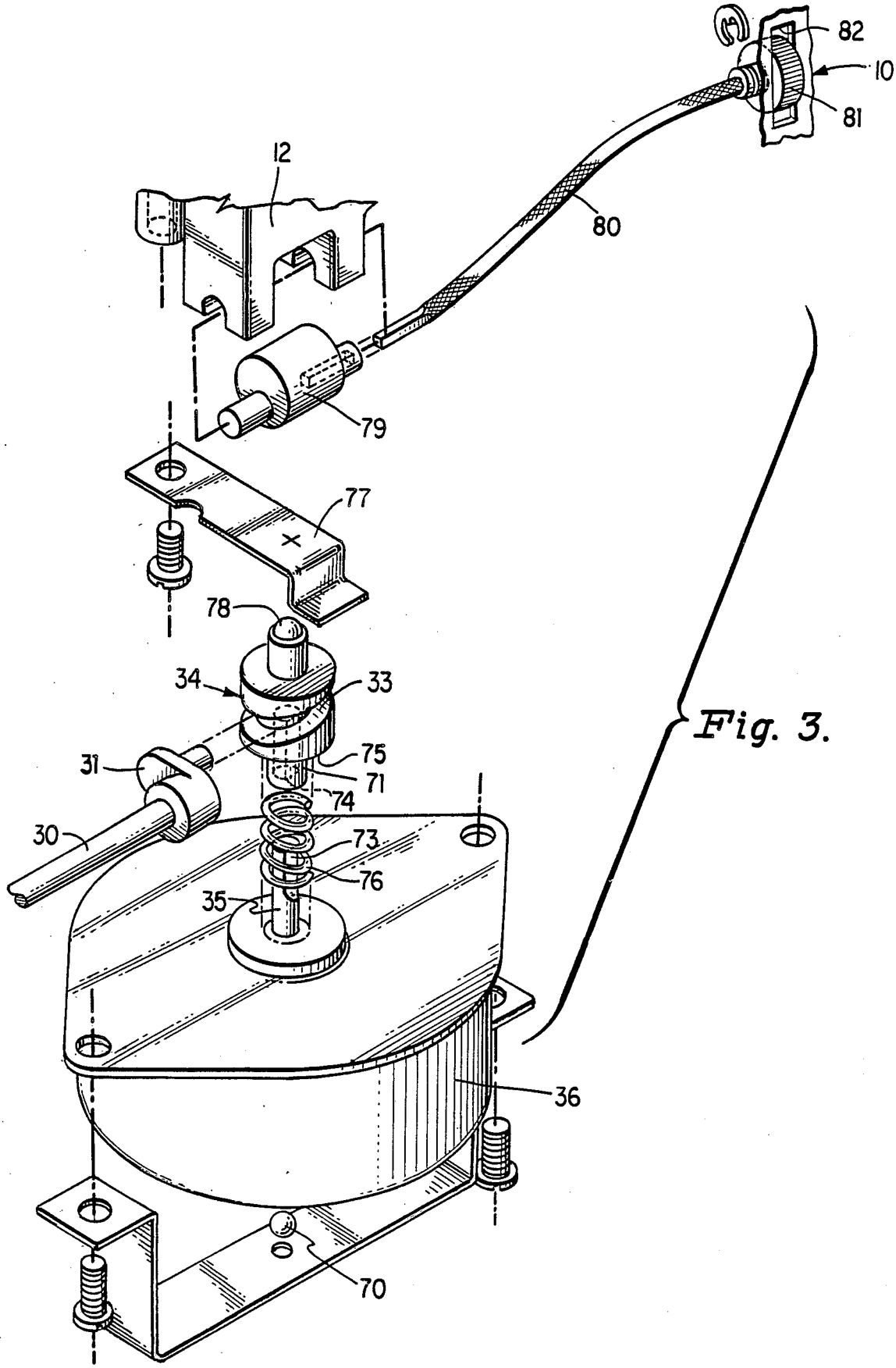
FIG. 3 is a disassembled view of a modified form of stepper actuated mechanism and operator influenced balance control from that illustrated in FIG. 1 and 2.

FIG. 3 illustrates a modification of the operator influenced means for effecting work feed balance.

In the embodiment of FIG. 3 the stepper motor shaft 35 is constrained against axial movement by thrust bearing 70 and the cam member 34 is formed with a cam shaft 71 separate from but keyed to the stepper motor shaft as by the non-circular configuration 73 of the stepper shaft 35 and a matching non-circular configuration of a cam shaft bore 74. Between the stepper shaft 35 and a shoulder 75 on the cam member 34 a coil spring 76 is arranged biasing the cam member away from the stepper motor 36. A leaf spring 77 secured in the sewing machine frame extends across the free extremity of the cam shaft and abuts a ball bearing 78 constrained axially in the cam shaft extremity.

An eccentric 79 journaled in the machine frame at the opposite side of the leaf spring 77 from the cam shaft serves to impart controlled force to position the cam shaft and with it the cam member 34 in opposition to the coil spring 76. A flexible shaft 80 may be used to connect the eccentric 79 with an operator influenced knob 81 projecting through an access opening 82 in the machine frame.

It will be appreciated that in either embodiments illustrated and described herein, the force applied to the cam member and stepper motor shaft to influence stitch balance being applied directly along the axis of rotation of the stepper motor shaft and/or cam shaft by means of the axially constrained ball bearings, will impart virtually no torque opposing stepper drive movements. These embodiments thus provide advantageous and cost effective operator influenced work feed balancing arrangements for stepper driven sewing machine work feed controls.

Having set forth the nature of this invention what is claimed herein is:

1. In a sewing machine having a frame, work feeding mechanism carried in said frame, a stepper motor carried in said frame, drive mechanism responsive to actuation from said stepper motor for controlling magnitude and direction of work feed movement influenced by said work feeding mechanism, said drive mechanism including cam means having an axis of rotation in said sewing machine frame and follower means tracking said cam means in movement substantially parallel to the axis of rotation of said cam mechanism, and operator influenced mechanism for controlling the balance between forward and reverse directions of work feeding motion said operator influenced mechanism comprising:

spring means arranged between said cam means and said sewing machine frame biasing said cam means axially in one direction, a balance control cam arranged between said cam means and said sewing machine frame for applying force to said cam means axially in a direction opposite said spring bias, and operator influenced means for shifting said balance control cam.

2. Sewing machine work feed balancing control mechanism as set forth in claim 1 in which ball bearings constrained axially of said cam means are interposed between said cam means and both said spring means and said balance control cam.

3. Sewing machine work feed balance control mechanism as set forth in claim 1 in which said balance control cam is wedge shaped and is formed on an elongate member constrained for linear movement in said sewing machine frame, a rack formed on said elongate member in spaced relation to said balance control cam, and said operator influenced means includes a dial journaled in said sewing machine frame accessible to a sewing machine operator and a gear rotatably associated with said dial and meshing with said rack providing operator influence on the axial positon of said cam means for effecting balance control.

4. Sewing machine work feed balancing control mechanism as set forth in claim 1 in which said balance control cam comprises an eccentric journaled in said frame, a force transmitting member arranged between said eccentric and the axis of said cam means, and said operator influenced means includes an operator accessible control knob and flexible shaft connecting said control knob with said eccentric providing operator influence on the axial position of said cam means for effecting balance control.

* * * * *